United States Patent [19]

Kozacka et al.

[11] 4,227,167

[45] Oct. 7, 1980

[54] HIGH-INTERRUPTING CAPACITY FUSE

[75] Inventors: Frederick J. Kozacka, South Hampton, N.H.; Howard G. Wilks, Newbury, Mass.

[73] Assignee: Gould Inc., Rolling Meadows, Ill.

[21] Appl. No.: 39,621

[22] Filed: May 16, 1979

[51] Int. Cl.[3] ..... H01H 85/12

[52] U.S. Cl. ..... 337/161; 337/295; 337/296

[58] Field of Search ..... 337/160, 161, 163, 164, 337/166, 293, 295, 296

[56] References Cited

U.S. PATENT DOCUMENTS

| | | | |
|---|---|---|---|
| 3,116,389 | 12/1963 | Withers | 337/293 X |
| 3,123,693 | 3/1964 | Kozacka | 337/296 X |
| 3,523,265 | 8/1970 | Feenan et al. | 337/295 X |
| 4,118,684 | 10/1978 | Möllenhoff | 337/296 |
| 4,146,863 | 3/1979 | Möllenhoff | 337/296 |

*Primary Examiner*—George Harris
*Attorney, Agent, or Firm*—Erwin Salzer

[57] ABSTRACT

Fuses having different ratings, all of which comply with the Standard for Class L fuses of the Underwriters Laboratories Inc.

The fusible elements of the fuses have identical points of reduced cross-section which fuse simultaneously on major fault currents, except one point of reduced cross-section which fuses ahead of the others.

A relatively large temperature gradient prevails between the aforesaid points of reduced cross-section that fuse on short circuit current and the M-effect low fusing point overlay of the copper links that severs the current path through the latter by a diffusion process. The M-effect overlay metal may just reach its fusing point, while the immediately adjacent points of reduced cross-section may have a much higher temperature, e.g. 300° to 400° C. Thus the fusing M-effect metal will flow to the point of higher temperature and a rapid severing of the latter will take place.

To meet the changes of heat flow the fuses having fusible element of silver to fusible element of copper requires much coarser arc-extinguishing quartz fillers that have proved to be necessary, or desirable, heretofore, in Class L fuses.

12 Claims, 7 Drawing Figures

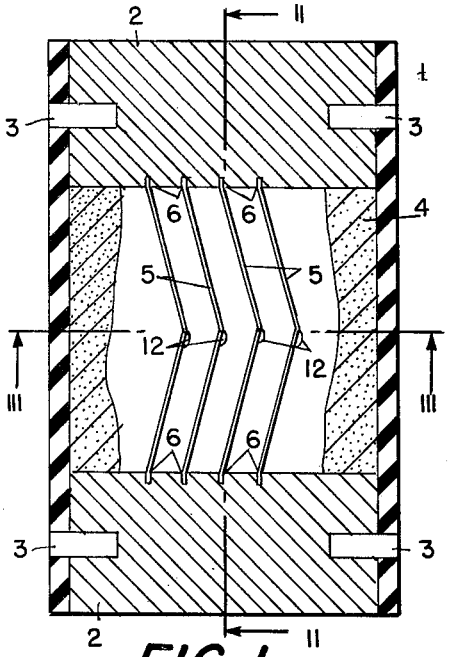
FIG. 1
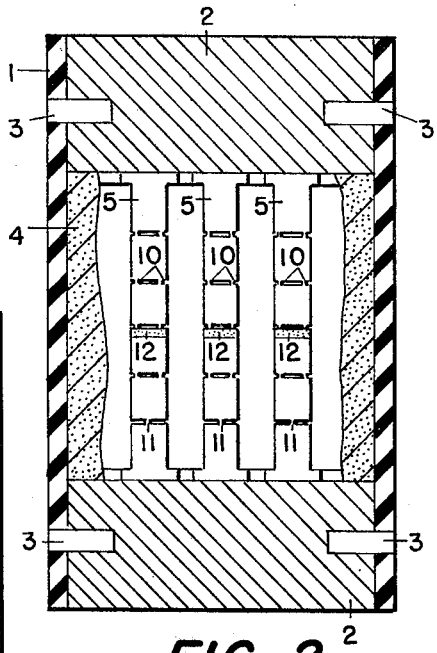
FIG. 2
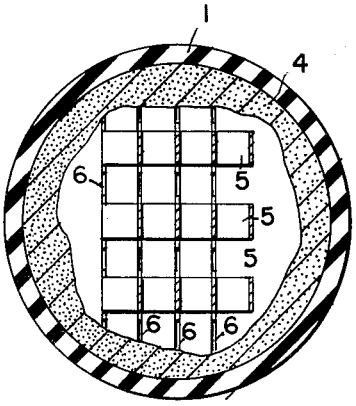
FIG. 3
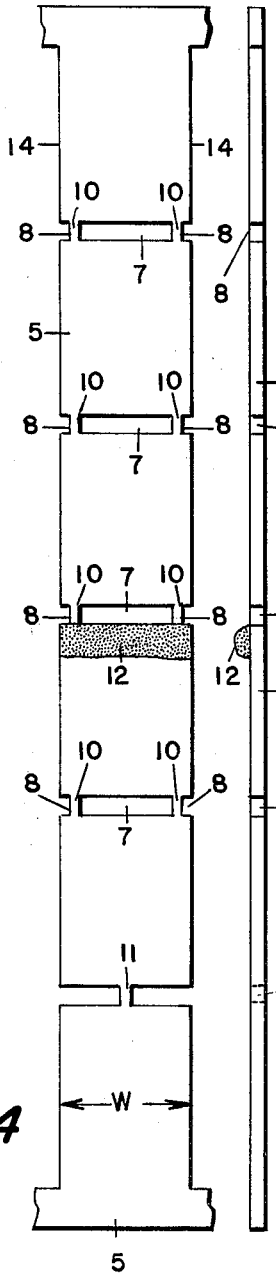
FIG. 4
FIG. 5
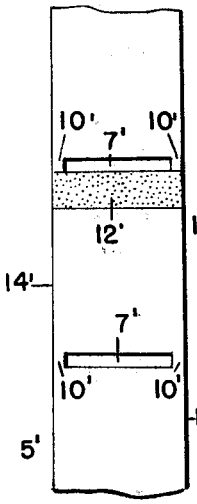
FIG. 6
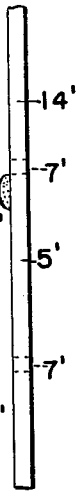
FIG. 7

HIGH-INTERRUPTING CAPACITY FUSE

BACKGROUND OF THE INVENTION

This invention relates to electric high-interrupting capacity, current-limiting fuses complying with Underwriters Laboratories Inc. Standard for Class L fuses, generally referred-to by the abbreviation UL 198.2.

Such fuses when carrying 150 percent of their current rating shall clear within 240 minutes.

Class L fuses come in predetermined current ratings and cartridge sizes, more fully set forth in UL 198.2, Table 22.1. The current-carrying capacity of Class L fuses must be high.

The interrupting rating of Class L fuses must be high as spelled out more particularly in UL 198.2, paragraphs 12.29 and 12.33A.

For further requirements of fuses complying with Underwriters Laboratories Inc. Standard for Class L fuses reference may be had to that Standard.

Heretofore all the fusible elements of a Class L fuse were made of silver, or a portion of the fusible elements were made of silver, and the remaining portions were made of copper. The terms silver and copper are used in this context to include silver and copper having impurities, or alloys of silver and copper which behave substantially in the same fashion as commercial pure silver and electrolytic copper.

It is the principal object of the present invention to provide Class L fuses all of the fusible elements of which are of copper.

The resistivity of silver at 20° C. is $1.64\times10^{-6}$ ohm/cm, and the resistivity of copper at 20° C. is $1.72\times10^{-6}$ ohm/cm. The fact that the resistivity of copper is higher than that of silver calls for an increase of the total cross-sectional area of the fusible elements of copper in regard to the total cross-sectional area of fusible elements of silver, all other conditions remaining unchanged. In other words, a Class L fuse of a given current rating, all the fusible elements of which are of copper, involves a larger mass of metal than a Class L fuse having the same current rating, but all the fusible elements of which are of silver. The relative increase in mass of fusible element metal raises the problem of de-ionizing and cooling the increased body of metal vapors resulting from blowing of the fuse.

Another factor that must be considered when switching from fusible elements of silver to fusible elements of copper is the difference in ionization potential of silver vapor and copper vapor at given temperatures.

Still another factor that must be considered is the temperature coefficient of resistance of silver and copper, respectively.

The resistance and temperature of a fusible element of copper increase at the same rate as the resistance and temperature of a fusible element of silver when both are subjected to the same conditions, in particular the same current. Hence this aspect of the changeover from silver to copper does not involve any problem.

In fuses having an overlay of a low fusing point metal, such as tin, on a high fusing point base metal, such as silver, or copper, the interdiffusion of the two metals, generally referred to as M-effect, depends upon their temperature. The interdiffusion will occur at a relatively slow rate, at relatively low temperatures, and occur at a relatively high rate, at relatively high temperatures. It is a fact for which several reasons may be assigned that it takes much more time to sever by M-effect fusible elements of copper than fusible elements of silver, all other conditions remaining unchanged.

It is, therefore, a prime object of this invention among the several objects thereof to provide fusible elements of copper suitable for Underwriters Laboratories Inc. Standard Class L fuses, i.e. wherein the M-effect severing process is relatively rapid, or closer to that occurring in Class L fuses having fusible elements of silver. To be more specific, the fusible elements of copper according to this invention must clear within 240 minutes when the fuse is carrying a current 150 percent of its rating, as required by the standard under consideration. Many prior art fusible elements of copper do not clear at all at such small overloads.

Silver has a total $i^2\cdot t$ value of $8.00\times10^8$ (amp/cm$^2$)$^2$-sec., i.e. this is the sum of the $i^2\cdot t$ value to bring silver from 20 deg. C. up to the melting point, the $i^2\cdot t$ value of the melting period required to supply the latent heat of fusion, the $i^2\cdot t$ value to bring the melted silver up to its vaporization temperature and the $i^2\cdot t$ value required to supply the latent heat of vaporization. Copper has a total $i^2\cdot t$ value of $11.72\times10^8$ (amp/cm$^2$)$^2$/sec. Therefore the changeover from fusible elements of silver to fusible elements of copper requires a decrease of the points of reduced cross-sectional area of the latter, all other conditions remaining unchanged.

RELATED PATENTS

The prior art patents known to applicants and believed by them to be most pertinent to their present invention are listed below:

- U.S. Pat. No. 2,599,646; F. J. Kozacka; 06/10/52 for CURRENT LIMITING FUSE.
- U.S. Pat. No. 2,653,203; F. J. Kozacka; 09/22/53 for CURRENT-LIMITING FUSE.
- U.S. Pat. No. 2,658,974; F. J. Kozacka; 10/10/53 for HIGH CURRENT CARRYING CAPACITY CURRENT-LIMITING FUSES.
- U.S. Pat. No. 2,662,140; F. J. Kozacka; 12/08/53 for SUPERCURRENT FUSE.
- U.S. Pat. No. 4,118,684; Klaus Mollerhoff; 10/03/78 for ONE PIECE FUSIBLE CONDUCTOR FOR LOW VOLTAGE FUSES.
- Brit. Pat. No. 1,523,575; Siemens Aktiengesellschaft; 09/06/78 for FUSIBLE ELECTRICAL CONDUCTORS.

SUMMARY OF THE INVENTION

Fuses embodying this invention include a plurality of fusible elements all of which are of copper, or an equivalent alloy. Each of said plurality of fusible elements has a plurality of serially related identical points of reduced cross-section. These points include one point situated adjacent the center of each of said plurality of fusible elements where the highest temperature prevails when the fuse is carrying current. Each of said plurality of points of reduced cross-sectional area formed by a pair of parallel current paths arranged between a transverse relatively wide rectangular perforation and preferably a pair of relatively narrow rectangular perforations aligned with said relatively wide rectangular perforation and extending across one of the edges of said plurality of fusible elements. Each of said pair of parallel current paths is so narrow that their joint total $i^2\cdot t$ value is relatively small. Each fusible element may include a point of reduced cross-section having an even smaller total $i^2\cdot t$ value to limit the overshoot of current flow.

Each fusible element is provided with an M-effect causing overlay of a metal having a considerably lower fusing point than copper, e.g. tin. Said overlay is arranged immediately adjacent one of said pairs of parallel current paths where the temperature of the particular fusible elements is highest when it is carrying current. Said overlay is further arranged at the ends of one of said pairs of parallel current paths in the center of the fuse where the temperature is highest when the fuse is carrying current and in spaced relation from said one of said pairs of parallel current paths. As a result, said one of said pairs of parallel current paths performs the dual function of establishing a current-limiting break at the occurrence of major fault currents simultaneously with the other of said pairs of parallel current paths of each of said plurality of fusible elements and said one of said pairs of parallel current paths further establishes at the occurrence of minor overload currents a non-current-limiting break by the flow of said overlay, when liquefied, to said one of said pairs of parallel current paths. In view of the temperature difference between said overlay and said one of said pairs of parallel current paths the break formation at one of said pairs of parallel current paths will be relatively rapid or, to be more specific, in compliance with the Underwriters Laboratories Inc. Standard for Class L fuses.

BRIEF DESCRIPTION OF THE DRAWINGS

FIG. 1 is a longitudinal section of a fuse embodying the present invention;

FIG. 2 is a section along II—II of FIG. 1;

FIG. 3 is a section along III—III of FIG. 1;

FIG. 4 shows a preferred ribbon-type fusible element of the structure of FIGS. 1 to 3 on a scale larger than 1:1;

FIG. 5 is a side elevation of the fusible element shown in FIG. 4 drawn on the same scale as FIG. 4;

FIG. 6 shows the center portion only of a modification of the fusible element of FIGS. 4 and 5; and FIG. 7 is a side elevation of FIG. 6.

DESCRIPTION OF PREFERRED EMBODIMENT

In the drawings numeral 1 has been applied to indicate a tubular casing of electric insulating material such as, for instance, glass-cloth melamine. A pair of terminal elements or terminal plugs 2 are inserted into casing 1 and close the same. Terminals 2 are of an electroconductive material such as copper or brass. Steel pins 3 interconnect casing 1 and terminal elements 2. An arc-quenching filler 4, including quartz sand, is filled into casing 1. The arc-quenching filler 4 is of a critical nature as will be described below in greater detail. In FIGS. 1 and 2 filler 4 has been shown only adjacent the interface with casing 1, but it is actually intended to fill all of casing 1 not occupied by other parts. A plurality of ribbon-type fusible elements 5 inside of casing 1 and immersed in filler 4 conductively interconnects terminals 1. In the embodiment shown there are $4\times3=12$ fusible elements 5. All twelve fusible elements are of copper, or of an alloy of copper, considered in the trade as copper. The axially outer ends of elements 5 are inserted into grooves 6 provided in terminal 1 and conductively conducted, as by solder joints not shown, with terminal 1. Fusible elements 5 are bent in their center into two sections which enclose an obtuse angle. Each of fusible elements 5 has a plurality of relatively large, rectangular perforations 7, extending transversely across fusible elements 5 and being only of slightly shorter length than the width of elements 5. Each of fusible elements 5 further has a pair of relatively small rectangular perforations 8. Perforations 8 are open at the lateral edges 14 of said plurality of fusible elements 5. Perforations 7 and 8 are aligned in a direction transversely of fusible elements 5. All of perforations 7 are congruent, and all of perforations 8 are congruent. Each of said plurality of relatively large perforations 7, and each of said plurality of relatively small perforations 8, define therebetween a pair of parallel short and narrow current paths 10. These current paths 10 have such a small cross-sectional area that they may be considered as point heat sources when the fuse is carrying current. Each fusible element further includes an additional point of reduced cross-section 11. The cross-section of points 11 is smaller than the cross-section of parallel current paths 10,10 and, therefore, the total $i^2 \cdot t$ of each of points 11 is relatively small compared to the total $i^2 \cdot t$ of each parallel current path, 10,10. Total $i^2 \cdot t$ means the $i^2 \cdot t$ needed for raising the temperature of points 10,10 and 11, respectively, from room temperature to fusing temperature, plus the $i^2 \cdot t$ for providing the latent heat of fusion of points 10,10 and 11, plus the $i^2 \cdot t$ needed for raising the temperature of points 10,10 and 11, respectively, from fusing temperature to vaporization temperature, and the $i^2 \cdot t$ for providing the latent heat of vaporization of points 10,10 and 11, respectively. Points 10,10 and 11 are spaced equidistantly. Therefore one of the pair of parallel current paths 10, 10 of each of said plurality of fusible elements is positioned immediately adjacent the center of each of said plurality of fusible elements, i.e. immediately adjacent plane III—III. In that region the temperature of fusible elements 5 is at, or close to, its peak when the fuse is carrying current. A plurality of overlays 12 of an M-effect metal — i.e. a metal having a much lower fusing temperature than its supporting copper base and capable of severing the latter by a metallurgical reaction in the nature of an interdiffusion process — is provided on fusible elements 5, i.e. an overlay 12 on each fusible element 5. Overlays 12 are located immediately adjacent the centers of fusible elements 5, where their temperature is highest. Overlays 12 are arranged immediately adjacent to, but spaced from, said pair of parallel current paths 10,10 of each of said plurality of fusible elements 5. Each overlay 12 has a first boundary line immediately adjacent the center aperture 7 of a fusible element 5, and has a second boundary line remote from the center aperture 7 of a fusible element 5. The first mentioned boundary line is a substantially straight line extending across the entire width W of each fusible element 5. As long as overlays 12 are in their solid rather than their liquid state, they are spaced from parallel current paths 10,10 and do not overlap the latter.

The plurality of pairs of parallel current paths 10,10 have the dual function of vaporizing simultaneously on occurrence of major fault currents which is the result of the sameness of their cross-section, and the result of the spacing of said plurality of overlays 12 from current paths 10,10. Current paths 10,10 would not vaporize simultaneously if the M-effect overlays were not separated from current paths 10,10. The simultaneous vaporization of current-paths 10,10 is essential to achieve the required current-limiting action since their vaporization yields the preponderance of the arc voltage required.

Current paths 10,10 immediately adjacent to plane III—III are severed with time delays as a result of the smallness of heat flow from points 10,10 to overlays 12, the relatively large mass of the latter, their latent heat of fusion and the time involved in the flow of the metal of which overlays 12 are made from their initial location to each of said pair of immediately adjacent current paths 10,10. Since the heat dissipation from overlays 12 in the direction opposite to the nearest aperture 7 is significant, and since overlays 12 extend across the entire width W of fusible elements 5, the heat flow away from overlays 12 is so large that sufficient time elapses in case of overloads before overlays 12 fuse. Thus the requirement of clearing times of 240 minutes when the load current is 150 percent of the rated current can be met, but when overlays 2 fuse, interruption is effected at a very rapid rate.

Before overlays 12 fuse, there will be a current flow in the direction from parallel current paths 10,10 toward overlays 12. After overlays 12 are liquefied, the metal of which they are made spills over parallel current paths 10,10 and severs the same. This is effected by two phenomena. First, the temperature gradient between overlays 12 and parallel current paths 10,10 may be high. The melting temperature of overlays 12 may be around 200° C., while the temperature at parallel current paths 10,10 may be, e.g. in the order of 400° C. The M-effect metal, when liquefied, tends to flow rapidly from its initial position to locations where the temperature is higher. It will, therefore, flow rapidly to parallel current paths 10,10. There the diffusion between overlay metal and base metal will be rapid, because the rate of diffusion increases with increasing temperature. Initially two arcs are formed, one at each of the parallel current paths 10,10. But arcs in parallel are unstable. Therefore, one arc will extinguish, and the other arc gap will be caused to carry the entire current, thus increasing the velocity of backburn.

The change of fusible elements of copper instead of fusible elements of silver greatly increases the amount of the metal vapor to be condensed or cooled, all other conditions remaining unchanged. This calls for larger interstices between particles of quartz sand to allow escape of the products of arcing away from their arcing zones. In fuses having fusible elements of silver best results were obtained with quartz sand having proponderantly particle sizes from 60 to 70 American Standard Sieve Number. In fuses according to this invention the particle size ought to be much coarser than in conventional time-lag fuses.

A fuse according to this invention or, to be more specific, any Underwriters Laboratories Standard Class L fuse has a given standard size which is rather small. Substitution of fusible elements of copper for fusible elements of silver must not involve any significant increase of the voltage drop across the fuse, i.e. the heat dissipated in a fuse having fusible elements of copper must be substantially the same as in a fuse having the same rating but fusible elements of silver. This calls for an increase of the total cross-sectional area of the fusible elements of copper to make up for their increased specific resistance. The total cross-sectional area of the fusible elements must be sub-divided into a relatively large number of fusible elements, the cross-section of each having a given fraction of the aforementioned total cross-sectional area. This is necessary for reasons of satisfactory short-circuit performance and other reasons. As a result of an increase of the number of fusible elements in a fuse having fusible elements of copper rather than of silver, the fusible elements must be spaced more narrowly from each other, and more narrowly from the casing of the fuse. The narrow spacing of the fusible elements from the casing has an increased heating effect on the latter, resulting in deterioration of the material of which the casing is made, which is generally a synthetic resin with limited heat resistance. The narrow spacing of the radially outer fusible elements from the internal wall of the casing would result in excessive outward heat flow which would also affect the required time-current characteristic, or current rating, of the fuse unless such heat flow is limited by the particular filler recited above.

We have found that an arc-quenching filler having a grain size of 20 to 30 American Standard Sieve Number, excluding substantially particles of finer grain size, is also critical inasmuch as in an Underwriters Laboratories Standard Class L fuse having a coarser particle size and larger particles interstices, the arc-quenching filler has not sufficient pressure-wave breaking power to break the pressure wave incident to vaporization of the fusible elements when the fuse blows on occurrence of major fault currents, or short-circuit currents. As a result, the casing of a fuse having a coarser particle size would burst by the impact of the pressure-wave incident to blowing of the fuse on major fault currents if the particle size of its granular arc-quenching filler was coarser, e.g. 10 to 20 American Standard Sieve Number.

There is still another very important reason for using in a fuse according to this invention a coarse arc-quenching filler including only particles of quartz sand between 20 and 30 American Standard Sieve Number to the substantial exclusion of particles of smaller size. It has been found that this increases greatly the effectiveness of the M-effect overlay which severs the base metal of the fusible element, i.e. copper, by a metal interdiffusion process. The greater interstices between greater particles facilitate the flow of the liquefied low fusing point overlay metal, while smaller quartz particles and smaller interstices result in "puddling" of the overlay metal, and poor severing of the base metal copper.

In FIGS. 6 and 7, the same reference numerals as in FIGS. 4 and 5 with a prime added have been applied to indicate like parts. The fusible element 5' has relatively large rectangular serially arranged perforations 7' all of which are congruent. The center perforation 7' is provided with an M-effect overlay 12' of a metal having a lower fusing point than fusible element 5' of copper. The small perforations 8 of FIGS. 4 and 5 have been deleted in FIGS. 6 and 7. FIGS. 6 and 7 operate theoretically in the same way as FIGS. 4 and 5, but in practice the performance of Underwriters Laboratories Class L fuses having fusible elements as shown in FIGS. 4 and 5 is far superior to that of fuses having fusible elements as shown in FIGS. 6 and 7. The reason underlying this fact is as follows. In any kind of copper strip of which fusible elements 5 and 5' are made, the longitudinal edges 14 and 14', respectively, are somewhat fuzzy. This fuzziness results in that the cross-sections of current-paths 10',10' cannot be absolutely identical, and consequently their $i^2 \cdot t$ values cannot be absolutely the same.

The punch with which the fusible elements of FIGS. 4 and 5 are made removes this drawback by removing the edges 14 where their possible fuzziness may affect the cross-section of parallel current paths 10,10. Thus the latter are absolutely identical within the limits of punching technology.

The operation of fuses embodying this invention has been stated above and will be briefly summarized below.

The ratio of the cross-section of necks, or points of reduced cross-section 11, to the cross-section of each of the two parallel current paths 10,10 is about 1:1, or the cross-section of each of the two parallel current paths 10,10 is equal to the cross-section of necks 11. Under such conditions the difference in blowing times of points 11 and parallel current paths 10,10 is very small, and the overshoot of the current-wave is kept very small.

On overload currents the temperatures of current paths 10,10 is above that of overlays 12, the degree of overheating depending on the degree of the overload current. When overlays 12 are liquefied, they spill over parallel current paths 10,10 and sever the latter.

Overlays 12 may be established by heating the portion of fusible elements 5 on which they are to be established, and not heating the opposite ends of the fusible elements 5. Under such conditions the temperature in the current paths 10,10 which separate the relatively hot from the relatively cold portion of each fusible element remains relatively low. Some insignificant amounts of M-effect metal, such as tin, may however be deposited on the side of current paths 10,10 immediately adjacent overlays 12. The height of overlay metal on current paths 10,10 will be much smaller at the overlays 12 proper, and no instances have ever been observed where the entire current paths 10,10 were covered by overlay metal.

We claim as our invention:

1. An electric high-interrupting capacity fuse complying with Underwriters Laboratories Inc. Standard for Class L fuses, said fuse comprising a casing of electric insulating material, a pulverulent arc-quenching filler including particles of quartz inside said casing, and a pair of terminal elements closing said casing on the ends thereof, and said fuse further comprising (a) a plurality of fusible elements conductively interconnecting said pair of terminal elements, all of said plurality of fusible elements being of copper to the exclusion of any fusible element of silver;

(b) each of said plurality of fusible elements having a plurality of identical, serially related regions of reduced cross-section, each of said regions being formed by a rectangular perforation extending transversely across said plurality of fusible elements having almost the same width as each of said plurality of fusible elements and defining a pair of parallel current paths each being substantially point shaped and located at one of the two narrow sides of said rectangular perforation;

(c) each of said plurality of fusible elements including one pair of said parallel current paths that is situated immediately adjacent to the center thereof where the highest temperature prevails when the fuse is carrying current; and (d) a plurality of M-effect causing overlays of a metal having a considerably lower fusing point than copper, each of said plurality of overlays extending transversely across the entire width of each of said plurality of fusible elements, each of said plurality of overlays, as long as in the solid state, being arranged immediately adjacent to, but in spaced relation from, said one pair of parallel current paths where the highest temperature prevails when said fuse is carrying current, and said plurality of overlays, when liquefied, flowing from the initial locations thereof toward said one pair of parallel current paths where the highest temperature prevails when said fuse is carrying current.

2. An electric fuse as specified in claim 1 wherein each of said regions of reduced cross-section is formed, in addition to said rectangular perforation, by a pair of much narrower identical rectangular perforations aligned with said rectangular perforation and open at the sides thereof coextensive with one of the lateral edges of one of said plurality of fusible elements.

3. An electric fuse as specified in claim 1 wherein there is a granular arc-quenching filler in said casing comprising substantially only particles as large as 20–30 American Standard Sieve Number.

4. An electric fuse as specified in claim 3 wherein each of said serially related regions of reduced cross-section is formed in addition to said rectangular perforation by a pair of relatively narrow rectangular perforations aligned with said rectangular perforation and open at the sides thereof coextensive with one of the lateral edges of one of said plurality of fusible elements, each said rectangular perforation and each said pairs of rectangular perforations defining therebetween a pair of parallel narrow current paths, and wherein each of said plurality of fusible elements is provided with an additional point of reduced cross-section which has a smaller total $i^2 \cdot t$ than said plurality of regions of reduced cross-section, said additional point of reduced cross-section being situated so close to one of said terminal elements of said fuse that it has virtually no effect on the time-current characteristic thereof.

5. An electric high-interrupting-capacity fuse complying with Underwriters Laboratories Standards for Class L fuses, said fuse comprising in combination (a) a tubular casing of electric insulating material;

(b) a pair of terminal plugs closing the ends of said casing;

(c) an arc-quenching filler inside said casing including quartz sand;

(d) a plurality of ribbon-type fusible elements inside said casing conductively interconnecting said pair of terminal plugs and embedded in said arc-quenching filler, each of said plurality of fusible elements being of copper to the exclusion of any fusible element of silver;

(e) each of said plurality of fusible elements having a plurality of relatively wide rectangular perforations extending in transverse direction and each of said plurality of fusible elements further having a plurality of pairs of relatively narrow rectangular perforations each aligned with one of said plurality of relatively wide rectangular perforations and open at the lateral edges of said plurality of fusible elements, each of said plurality of relatively wide perforations being congruent and each of said plurality of pairs of relatively narrow perforations being congruent, each of said plurality of relatively wide perforations and each of said plurality of pairs of relatively narrow perforations defining therebetween a pair of parallel short and narrow current paths;

(f) one of said pair of parallel current paths of each of said plurality of fusible elements being positioned immediately adjacent the center thereof where the prevailing temperature is highest when said fuse is carrying current; and (g) a plurality of overlays of a metal having a much lower fusing point than the fusing point of copper and capable of severing copper by an interdiffusion process, each of said plurality of overlays extending in a transverse direction across the entire width of each of said plurality of fusible elements, and each of said plurality of overlays being substantially limited in the solid state thereof to a portion of the surfaces of said plurality of fusible elements immediately adjacent to, but spaced from, said one of said pair of parallel current paths where the temperature is highest when said fuse is carrying current, and each of said plurality of overlays substantially exposing in the solid state thereof said pair of parallel current paths where the temperature is highest when said fuse is carrying current.

6. An electric high-interrupting capacity fuse as specified in claim 5 wherein each of said plurality of fusible elements defines in addition to pairs of parallel current paths a point of restricted cross-section whose cross-section is smaller than the aggregate cross-section of each of said pairs of parallel current paths and that is situated so close to one of said pair of terminal plugs that the presence of said point of restricted cross-section has no significant effect on the time-current characteristic of said fuse, and wherein said arc-quenching filler comprises preponderantly quartz sand having a particle size of 20 to 30 American Standard Sieve Number to the exclusion of significant amounts of quartz particles of larger and smaller size.

7. An electric high-interrupting capacity fuse complying with Underwriters Laboratories Standards for Class L fuses, said fuse comprising in combination (a) a tubular casing of electric insulating material;

(b) a pair of terminal elements closing the ends of said casing;

(c) an arc-quenching filler of quartz sand inside said casing, the particle size of said quartz sand being preponderantly 20 to 30 American Standard Sieve Number to the exclusion of significant amounts of quartz particles of larger and smaller size;

(d) a plurality of ribbon-type fusible elements inside said casing, immersed in said arc-quenching filler and conductively interconnecting said pair of terminal elements, each of said plurality of fusible elements being of copper;

(e) each of said plurality of fusible elements having a first point of reduced cross-section having a minimal total $i^2 \cdot t$, said first point of reduced cross-section being located so close to one of said pair of terminal elements as to have virtually no effect on the time-current curve of said fuse;

(f) each of said plurality of fusible elements having further a plurality of relatively wide equidistantly spaced substantially rectangular perforations extending in transverse direction, and each of said plurality of fusible elements further having a plurality of pairs of relatively narrow substantially rectangular perforations open at the lateral edges of one of said plurality of fusible elements, each of said plurality of relatively wide perforations being aligned with one of said plurality of said pairs of relatively narrow perforations, and each of said plurality of relatively wide perforations and each of said plurality of pairs of relatively narrow perforations defining a pair of congruent parallel short current paths therebetween, each pair of current paths having a total $i^2 \cdot t$ larger than said minimal total $i^2 \cdot t$ of said first point of reduced cross-section of each of said plurality of fusible elements;

(g) one of said pair of parallel current paths of each of said plurality of fusible elements being positioned adjacent the center of each of said plurality of fusible elements in a region where the prevailing temperature along said plurality of fusible elements is at its peak when said fuse is carrying current; and (h) a plurality of low fusing point overlays on said plurality of fusible elements each having a much lower fusing point than copper and being capable of severing an electric current path through a conductor of copper, each of said plurality of overlays having a width equal to the width of each of said plurality of fusible elements and being substantially limited, as long as in the solid state, to a portion of the surface of said plurality of fusible elements immediately adjacent to, but spaced from, said pair of parallel current paths adjacent the center of each of said plurality of fusible elements, said pair of current paths adjacent the center of each of said plurality of fusible elements being substantially exposed by said plurality of overlays as long as said plurality of overlays are in the solid state, and each of said plurality of overlays upon fusion thereof flowing toward, and thereby interrupting, said one of said pair of parallel current paths adjacent the center of each of said plurality of fusible elements.

8. An electric high-interrupting capacity fuse complying with Underwriters Laboratories Standards for Class L fuses, said fuse comprising in combination (a) a tubular casing of electric insulating material;

(b) a pair of terminals inside the ends of said casing and closing said casing;

(c) an arc-quenching filler of coarse quartz sand inside said casing;

(d) a plurality of ribbon type fusible elements of copper only inside said casing, immersed in said arc-quenching filler and conductively interconnecting said pair of terminals;

(e) each of said plurality of fusible elements having a first point of reduced cross-section having a relatively small cross-section, said first point of reduced cross-section being located so close to one of said pair of terminals as to have virtually no effect on the time-current curve of said fuse;

(f) each of said plurality of fusible elements having further a plurality of equidistantly spaced second points of reduced cross-section having a larger cross-section than said first point of reduced cross-section, each of said second points of reduced cross-section being formed by relatively wide rectangular perforations extending in transverse direction and a pair of relatively narrow rectangular perforations each arranged to opposite sides of said relatively wide perforation and open along one of the lateral edges of said plurality of fusible elements, each of said relatively wide perforations and each of said pair of relatively narrow perforations defining a pair of parallel current paths therebetween;

(g) one of said pair of parallel current paths of each of said plurality of fusible elements being positioned immediately adjacent the center of each of said plurality of fusible elements in a region where the temperature along said plurality of fusible elements is close to its peak when said fuse is carrying current;

(h) a plurality of overlays of an M-effect metal each on one of said plurality of fusible elements and each arranged immediately adjacent to, but spaced from, said one of said pair of parallel current paths, each of said plurality of overlays absorbing without liquefying in the permissible overload range of said fuse most of the heat generated in said pair of parallel current paths immediately adjacent thereto, and each of said plurality of overlays liquefying and flowing over said pair of parallel current paths immediately adjacent thereto when said overload range is exceeded.

9. An electric fuse as specified in claim 8 wherein said arc-quenching filler is preponderantly of a grain size of 20 to 30 American Standard Sieve Number, to the substantial exclusion of quartz particles of larger and smaller grain size.

10. An electric high-interrupting capacity fuse complying with Underwriters Laboratories Standards for Class L fuses, said fuse comprising in combination (a) a tubular casing of electric insulating material;

(b) a pair of terminals inside the ends of said casing and closing said casing;

(c) an arc-quenching filler of coarse quartz sand inside said casing;

(d) a plurality of ribbon-type fusible elements of copper inside said casing, immersed in said arc-quenching filler and conductively interconnecting said pair of terminals;

(e) each of said plurality of fusible elements having a first point of reduced cross-section having a relatively small total $i^2 \cdot t$, said first point of reduced cross-section being located so close to one of said pair of terminals as to have virtually no effect on the time-current curve of said fuse;

(f) each of said plurality of fusible elements having further a plurality of equidistantly spaced second points of reduced cross-section, each of said plurality of second points of reduced cross-section having the same total $i^2 \cdot t$ which is larger than the total $i^2 \cdot t$ of said first point of reduced cross-section, each of said plurality of second points of reduced cross-section being formed by a relatively wide rectangular perforation extending in transverse direction and a pair of relatively narrow rectangular perforations each aligned with and arranged to opposite sides of one of said relatively wide perforations and open along the lateral edges of one of said plurality of fusible elements, each of said relatively wide perforations and each of said pair of relatively narrow perforations defining a pair of parallel current paths therebetween;

(g) one of said pair of parallel current paths of each of said plurality of fusible elements being positioned immediately adjacent to the center thereof in a region where the temperature along each of said plurality of fusible elements is close to its peak when said fuse is carrying current;

(h) a plurality of overlays of an M-effect metal on said plurality of fusible elements arranged immediately adjacent to, but spaced from, said one of said pair of parallel current paths near to the hottest spot of each of said plurality of fusible elements; and (i) said one of said pair of parallel current paths performing the dual function of vaporizing simultaneously with the others of said pairs of parallel current paths on occurrence of major fault currents as a result of the sameness of their $i^2 \cdot t$ values and the spacing of said plurality of overlays therefrom, and of being severed with time delays as a result of the time involved in fusing said plurality of overlays and in the flow of the metal of which said overlays are made from their initial location to said one of said pair of parallel current paths near the hottest spot of each of said plurality of fusible elements.

11. An electric high-interrupting capacity fuse complying with Underwriters Laboratories Standards for Class L fuses, said fuse comprising in combination (a) a tubular casing including an electrical insulating resin;

(b) a pair of terminals closing the ends of said casing;

(c) a coarse arc-quenching filler including quartz sand inside said casing;

(d) a plurality of ribbon-type fusible current-carrying elements inside said casing, immersed in said arc-quenching filler, conductively interconnecting said pair of terminals, all of said fusible elements interconnecting said pair of terminals being of copper to the exclusion of any fusible element of silver;

(e) each of said plurality of fusible elements having a plurality of relatively wide, equidistantly spaced rectangular congruent perforations extending in a direction transversely thereof, and each of said plurality of fusible elements further having a plurality of pairs of relatively narrow rectangular congruent perforations each to opposite sides of one of said relatively wide perforations and open along one of the lateral edges of one of said plurality of fusible elements, each of said relatively wide perforations and each of said pair of relatively narrow perforations defining a pair of parallel current paths therebetween;

(g) one of said pair of parallel current-paths of each of said plurality of fusible elements being positioned immediately adjacent to the center thereof in a region where the temperature along each of said plurality of fusible elements is close to its peak when said fuse is carrying current; and (h) a plurality of overlays of an M-effect causing metal on said plurality of fusible elements arranged immediately adjacent to, but in spaced relation from, said one of said pair of parallel current paths when the temperature is close to its peak when said fuse is carrying current, each of said plurality of overlays being equal in width to the width of each of said plurality of fusible elements and having a first boundary line adjacent to and a second boundary line remote from one of said relatively wide perforations, and said first boundary line being a substantially straight line coextensive with the longer side of one of said relatively wide perforations.

12. An electric fuse as specified in claim 11 wherein each of said plurality of fusible elements has a point of reduced cross-section forming a single current path the total $i^2 \cdot t$ value of which is less than the total $i^2 \cdot t$ value of each of said pair of parallel current paths and which is arranged so close to one of said pair of terminals so as to have virtually no effect on the time current characteristic of the fuse, and wherein said arc-quenching filler consists of particles of quartz sand having substantially a grain size of 20 to 30 American Standard Sieve Number and being substantially free of particles of larger or smaller grain size.

* * * * *